US007515057B2

(12) United States Patent
Chen

(10) Patent No.: US 7,515,057 B2
(45) Date of Patent: Apr. 7, 2009

(54) POWER SOCKET HAVING A REED TO ACTIVATE AN ALARM

(76) Inventor: Siang-Shun Chen, No. 202, Jhongsing N. St., Sanchong City, Taipei County (TW)

( * ) Notice: Subject to any disclaimer, the term of this patent is extended or adjusted under 35 U.S.C. 154(b) by 313 days.

(21) Appl. No.: 11/544,022

(22) Filed: Oct. 6, 2006

(65) Prior Publication Data

US 2008/0084320 A1 Apr. 10, 2008

(51) Int. Cl.
*G08B 17/06* (2006.01)

(52) U.S. Cl. ..... 340/594

(58) Field of Classification Search ..... 340/594
See application file for complete search history.

(56) References Cited

U.S. PATENT DOCUMENTS 3,345,593 A * 10/1967 Grengg ..... 335/154
4,156,265 A * 5/1979 Rose ..... 361/179
5,590,010 A * 12/1996 Ceola et al. ..... 361/93.4
2006/0232366 A1* 10/2006 Li ..... 335/151

* cited by examiner

*Primary Examiner*—Jeff Hofsass
*Assistant Examiner*—John F Mortell
(74) *Attorney, Agent, or Firm*—Troxell Law Office PLLC

(57) ABSTRACT

A power socket having a reed to activate an alarm is constituted by a lower casing, an upper casing, and a conduction terminal which is inserted between the lower casing and the upper casing. The conduction terminal is provided with a dual-metal complex reed, and an interior of the lower casing is provided with a conduction piece for energizing an alarm device. Accordingly, when the conduction terminal reaches a certain high temperature, the dual-metal complex reed is buckled and deformed in accordance with its metallic properties, and is connected with the conduction piece, so as to activate the alarm device to give off sound or illuminate, thereby achieving a function of safety protection by alerting a user to pay attention to.

14 Claims, 10 Drawing Sheets

POWER SOCKET HAVING A REED TO ACTIVATE AN ALARM

BACKGROUND OF THE INVENTION (a) Field of the Invention

The present invention relates to a power socket having a reed to activate an alarm, and more particularly to a power socket which is provided with a dual-metal complex reed on a conduction terminal, such that an alarm device will be activated to illuminate or give off sound if the dual-metal complex reed is buckled and deformed when it achieves a certain high temperature, so as to alert a user promptly to prevent a tragedy from occurring.

(b) Description of the Prior Art

From time to time it is heard that people get killed in a fire. From a research of scholars and experts, it is determined that reasons of causing severe casualties of people include an improper use of indoor decoration and maintenance materials, a wire sparking, and an imperfect planning of a fire zone. In order to prevent a tragedy of casualties of fire from occurring again and again, it is imperative that a government should more actively develop related rules and regulations, such that a home safety can be more greatly protected.

As a matter of fact, from all kinds of scenes of fire, it is known that in addition to a human factor, the most essential reason should be the wire sparking. As a lifetime of usage of an ordinary building can be as long as several decades, when the wires are embedded in the building for a long time, they will be aging due to an external factor or power use. Under this condition, once there is an abrupt power surge, it is very easy to result in the wire sparking to start the fire.

SUMMARY OF THE INVENTION

The primary object of present invention is to provide a power socket having a reed to activate an alarm, wherein a conduction terminal of the socket is installed with a dual-metal complex reed which is buckled and deformed from a high temperature, to activate an alarm device, thereby overcoming a shortcoming of an electric circuit alarm by this mechanical operation.

Another object of the present invention is to provide a power socket having a reed to activate an alarm, wherein surfaces of the dual-metal complex reed and the conduction terminal are locally connected and locally disconnected, such that a contact area of the dual-metal complex reed with the conduction terminal can be increased in response to a temperature rise of the conduction terminal, thereby actually transmitting the precise temperature of conduction terminal.

Still another object of the present invention is to provide a power socket having a reed to activate an alarm, wherein an interior of a lower casing of the socket is provided with a conduction piece which can energize an alarm device; and on a surface of the conduction terminal, at a location close to the conduction terminal, is provided with a through-hole, such that the dual-metal complex reed can be connected to another surface of the conduction terminal by one end, and the other end of reed can be extended out of the through-hole along an edge of inner surface of the conduction terminal to form a bended angle, so as to form a normal close or a normal open state with the conduction piece.

Yet another object of the present invention is to provide a power socket having a reed to activate an alarm, wherein an alarm device can be installed inside or outside the socket to illuminate or give off sound for alarming.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
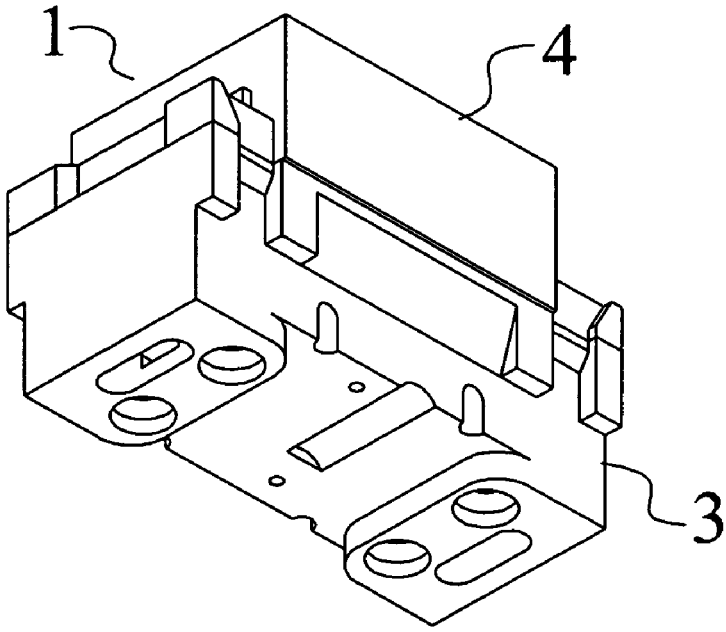
FIG. 1 shows a perspective view of the present invention.
Figure 2:
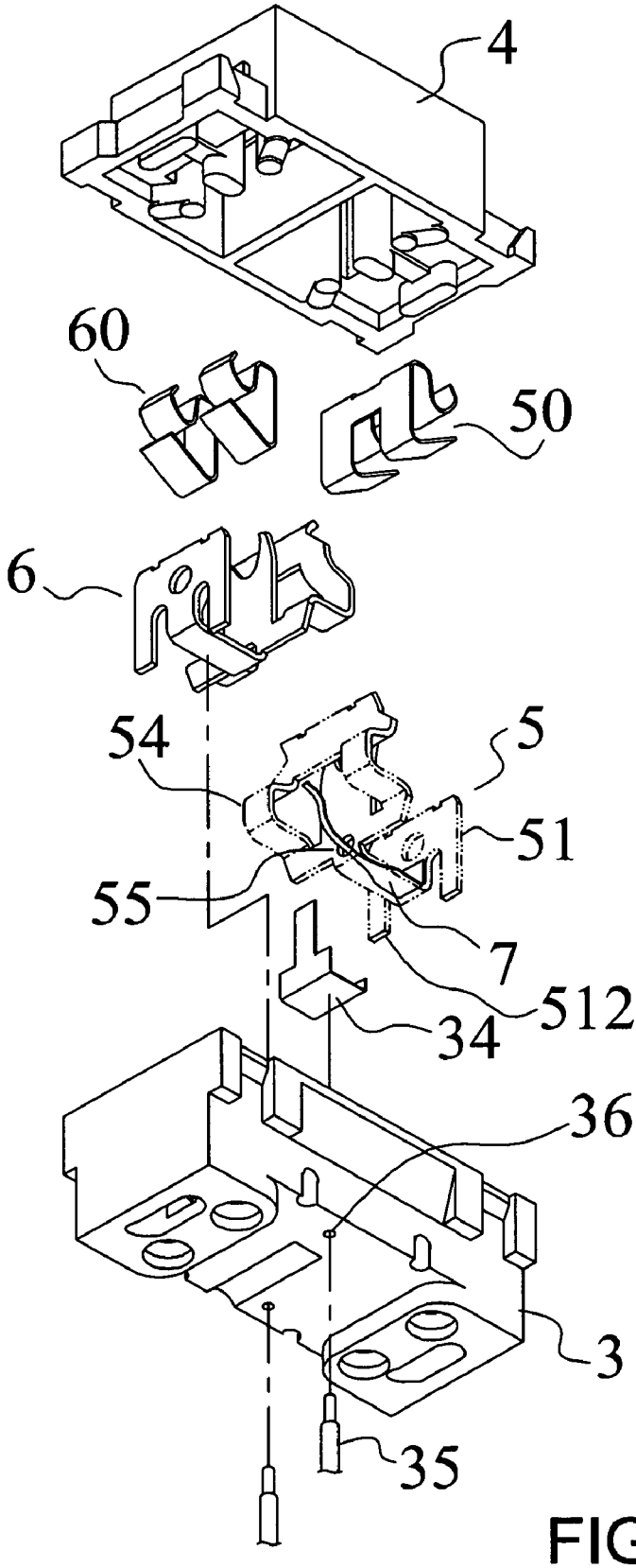
FIG. 2 shows a local exploded view of the present invention.
Figure 3A:
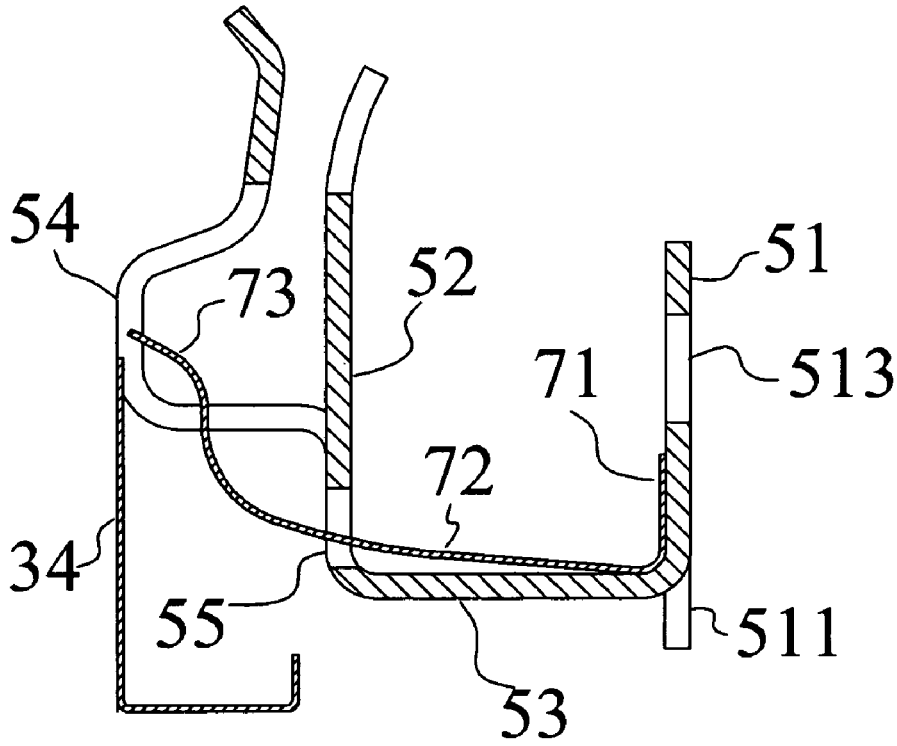
FIG. 3A shows a cutaway view of a conduction terminal and a dual-metal complex reed of the present invention.
Figure 3B:
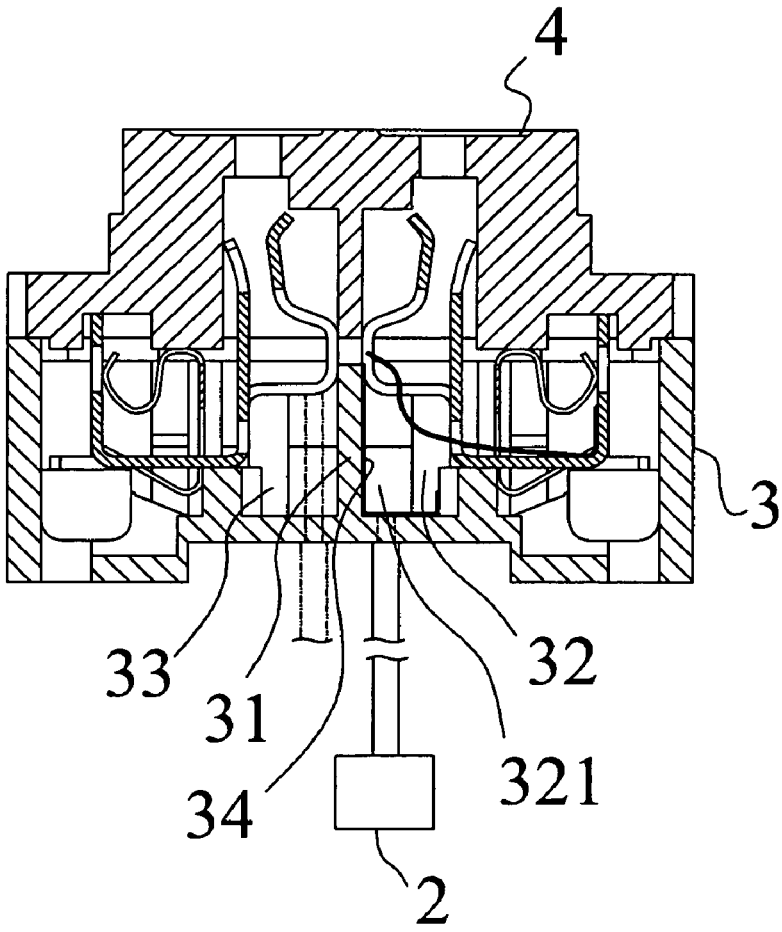
FIG. 3B shows a cutaway view of an entire assembly of the present invention.

Referring to FIGS. 1, 2, 3A, 3B, a power socket 1, an end of which is connected to an alarm device 2 (as shown in FIG. 3B), includes a lower casing 3, an upper casing 4, a first conduction terminal 5, a second conduction terminal 6, and a dual-metal complex reed 7, wherein an interior of the lower casing 3 is divided into a first chamber 32 and a second chamber 33 with a baffle 31, for placing the first conduction terminal 5 and the second conduction terminal 6, respectively; and the first conduction terminal 5 and the second conduction terminal 6 are provided with metallic auxiliary terminals 50, 60 respectively. As the aforementioned first conduction terminal 5 has a same shape as that of the second conduction terminal 6, features of the present invention are described using the first conduction terminal 5 as an example.

As shown in the drawings, the first conduction terminal 5 is made by a copper piece which is bended into a shape of terminal, and the terminal is provided with two vertical plates 51, 52 which are separated with each other by a proper distance. A bottom plate 53 is connected between the vertical plates 51, 52, two sides of the vertical plate 51 are provided with fixing pins 511, 512 which are extended downward, and the vertical plate 51 is provided with a round hole 513. Two sides of the vertical plate 52 are connected to an outer plate 54 which is bended by multiple angles, and two sides of which are formed outward into a projected station to allow the first conduction terminal 5 to be crossed over a projection body 321 of the first chamber 32 for fixing, when the first conduction terminal 5 is placed into the first chamber 32 of lower casing 3. In addition, a main body of the first conduction terminal 5 is again provided with a through-hole 55 which is located at a lower end of the vertical plate 52.

As shown in the drawings, the dual-metal complex reed 7 is in a shape of a long strip which is divided into an affixing section 71, a deformation section 72, and a triggering end 73. The affixing section 71 is attached on a surface below the round hole 513 of vertical plate 51, and on a part of the bottom plate 53, the deformation section 72 is bended upward by an angle, and is kept at a distance from the bottom plate 53 of first conduction terminal 5 such that it can be attached on the bottom plate 53 after deformation. A front end of the deformation section 72 transfixes into the aforementioned through-hole 55 of vertical plate 52, and a part of the deformation section 72 after passing through the through-hole 55 is bended and deflected by a larger angle, which forms the triggering end 73 with an angle of elevation at a tail end.

On the other hand, another conduction piece 34 is located on an inner wall of the first chamber 32, at a position opposed to the triggering end 73 of dual-metal complex reed 7. A bottom end of the conduction piece 34 is connected to a lead wire 35 which transfixes a bottom hole 35 of the lower casing 3 and is then connected to the alarm device 2, such that when the trigger end 73 of dual-metal complex reed 7 touches the conduction piece 34, the alarm device 2 can be activated to give off sound or illuminate.

Figure 4B:
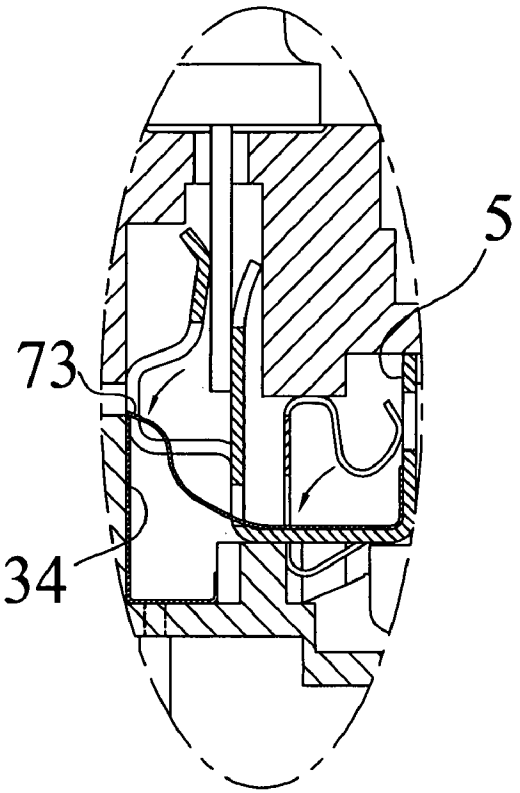
FIG. 4B shows a schematic view of a dual-metal complex reed of the present invention after deformation.
Figure 4A:
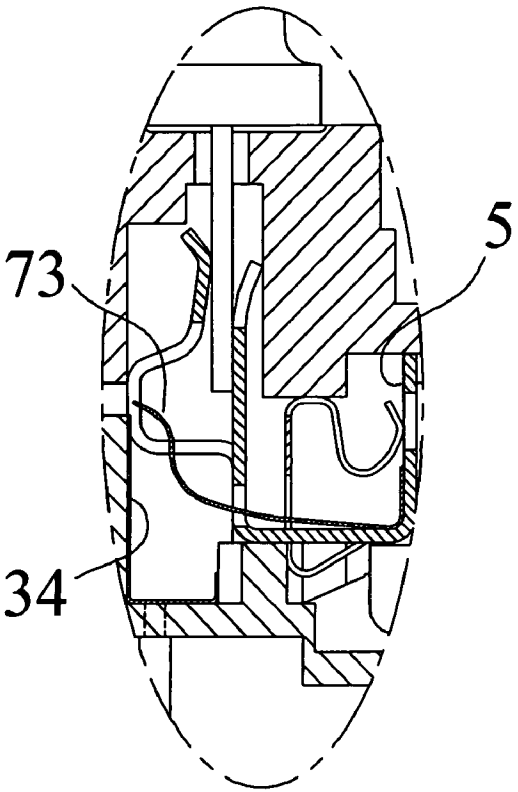
FIG. 4A shows a schematic view of a dual-metal complex reed of the present invention before deformation.

When using a power socket having a reed to active an alarm of the present invention, if the conduction terminal 5 has not been over-heated or its temperature has not been too high, the triggering end 73 of the dual-metal complex reed 7 will keep at a proper distance from the conduction piece 34 without touching (as shown in FIG. 4A). Whereas when the conduction terminal 5 is gradually heated, and the dual-metal complex reed 7 exceeds an upper limit of deformation of the deformation section 72 by an influence of the temperature of terminal, the deformation section 72 will start to deform due to its physical properties, and will be fully attached to the bottom plate 53 slowly, during the process of deformation, such that the entire temperature of conduction terminal 5 can be more accurately transmitted to the dual-metal complex reed 7, thereby finally enabling the dual-metal complex reed 7 to be deformed to a greater extent, until that the triggering end 73 of dual-metal complex reed 7 touches the conduction piece 34 to activate the alarm device 2 to give off the sound or illuminate.

Figure 5:
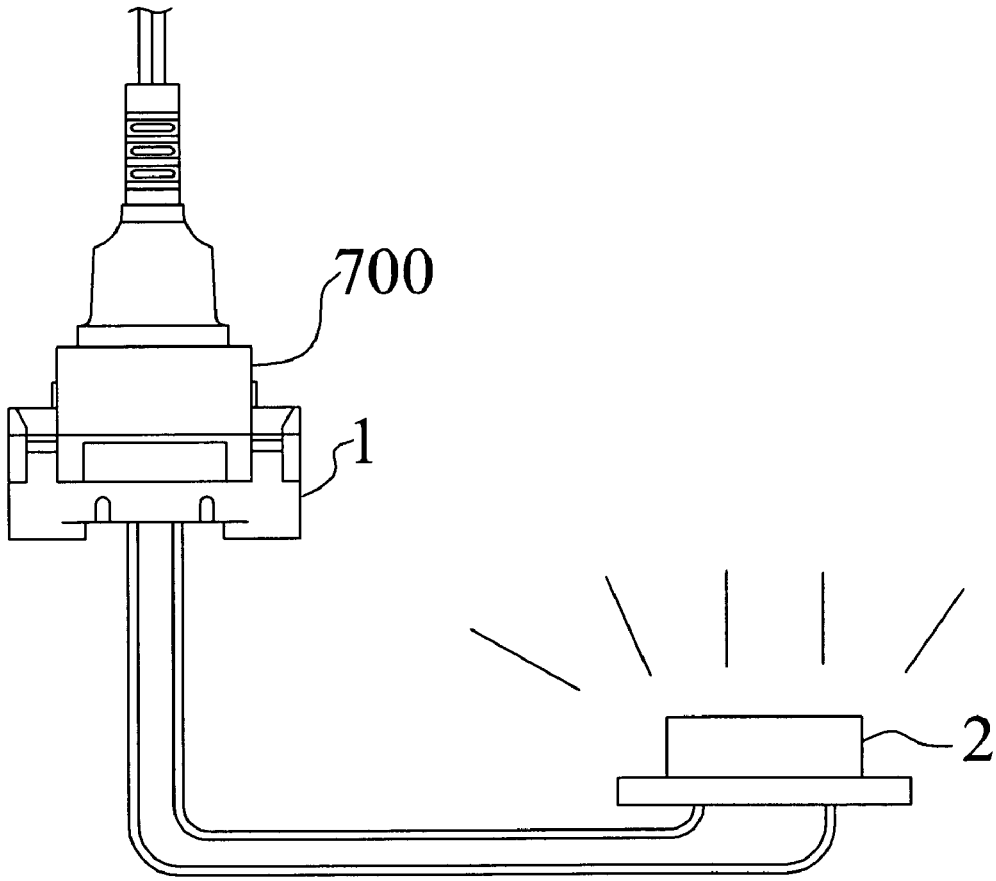
FIG. 5 shows a schematic view of the present invention in a usage.

Accordingly, referring to FIG. 5, in using a power socket having a reed to active an alarm of the present invention, when an electric load of an electric appliance which is used at one end of a plug 700 is excessively high to exceed an upper limit of a preset deformation of the dual-metal complex reed 7, the dual-metal complex reed 7 is first locally in contact with the conduction terminal 5, and then its contact area with the conduction terminal 5 is gradually increased due to a gradual heating of the conduction terminal 5, such that the heating temperature of conduction terminal 5 can be accurately sensed, and the conduction terminal 5 can be in contact with the conduction piece 34 immediately, to activate the alarm device 2 to give off the sound or illuminate, once an upper limit of the preset temperature is exceeded.

Figure 6:
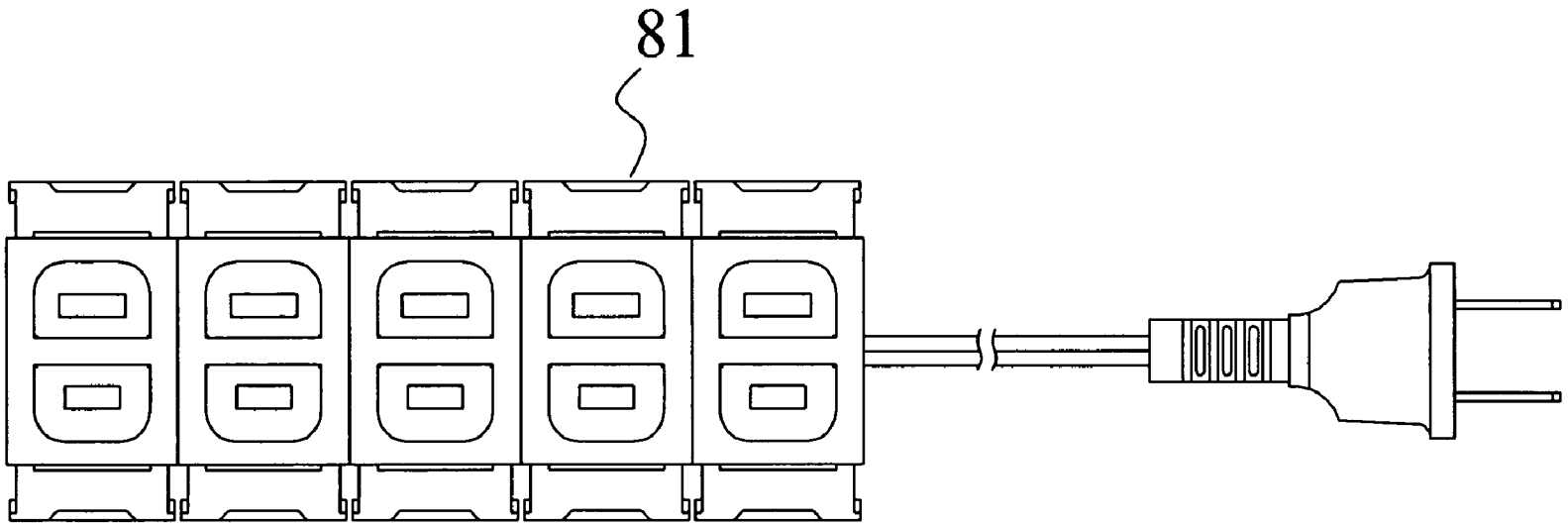
FIG. 6 shows a schematic view of a second embodient of the present invention.

Referring to FIG. 6, a power socket having a reed to active an alarm of the present invention is used in a socket 81 of an extension cord. As the socket 81 of extension cord is usually provided with too many insertion holes, it is easy for a user to ignore a load current and is usually to result in an overloading condition, which is very easy to cause a danger. By a contact of the dual-metal complex reed 7 on the conduction terminal with the conduction piece 34, the alarm device 2 can be activated promptly, to give off the sound or illuminate, thereby alerting the user to pay attention to.

Figure 7A:
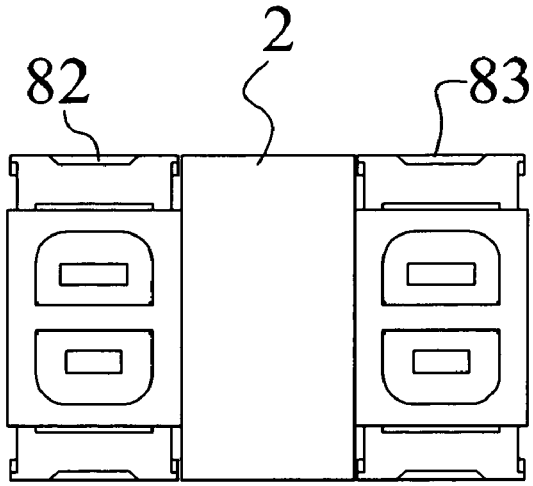
FIG. 7A shows a schematic view of a third embodient of the present invention.

Referring to FIG. 7A, a power socket having a reed to active an alarm of the present invention is provided with an alarm device 2 which is configured between two sockets 82, 83, and can be applied to an existing dual socket installed on a wall, so as to achieve a purpose of alerting a user to pay attention to in time.

Figure 7B:
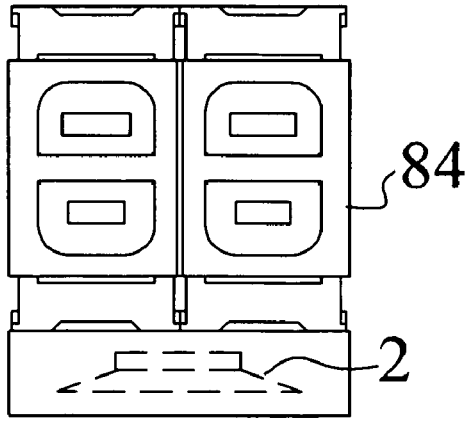
FIG. 7B shows a schematic view of a fourth embodient of the present invention.

Referring to FIG. 7B, a power socket having a reed to active an alarm of the present invention is provided with an alarm device 2 which is configured at a bottom of an interior of a socket 84, such that a space for installing the alarm device 2 can be decreased, thereby facilitating a more convenience in the installation and usage.

Figure 8A:
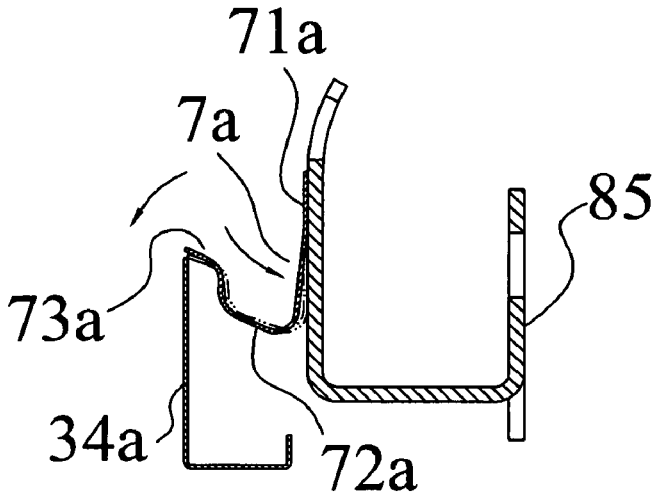
FIG. 8A shows a schematic view of a second embodient of a dual-metal complex reed and a conduction terminal of the present invention.

Referring to FIG. 8A, a dual-metal complex reed 7*a* can be also installed at an outermost side of conduction terminal 85, with its affixing section 71*a* and local deformation section 72*a* being attached to an outside of the conduction terminal 85. When the conduction terminal 85 is over-heated, the deformation section 7*a* is deformed to be attached on the outer surface of conduction terminal 85, and a triggering end 73*a* is again in contact with a conduction piece 34*a*. Therefore, when the conduction terminal 85 is over-heated, and the dual-metal complex reed 7*a* is deformed, the triggering end 73*a* will activate the alarm device to give off the sound or illuminate.

Figure 8B:
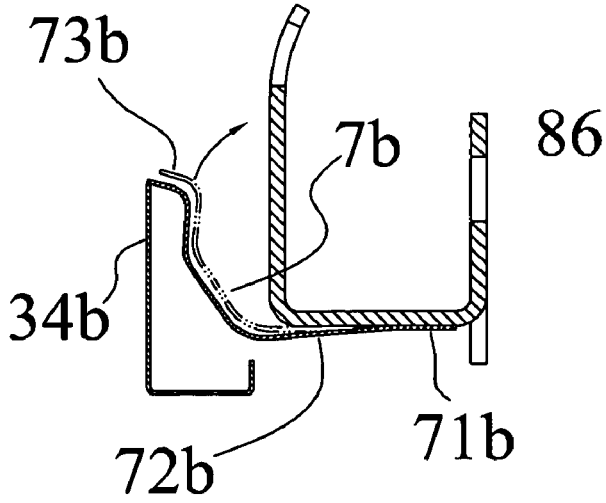
FIG. 8B shows a schematic view of a third embodient of a dual-metal complex reed and a conduction terminal of the present invention.

Referring to FIG. 8B, a dual-metal complex reed 7*b* can be also installed at a bottom surface of conduction terminal 86, with its affixing section 71*b* and local deformation section 72*b* being attached on the bottom surface of conduction terminal 86, enabling the dual-metal complex reed 7*b* and the conduction piece 34*b* to be at a normal close state. When the conduction terminal 86 is over-heated, the deformation section 72*b* is deformed to move upward and to be attached on the bottom surface of conduction terminal 86, and a triggering end 73*b* will be released to touch the conduction piece 34*b*, thereby activating the alarm device to give off the sound or illuminate.

Figure 9:
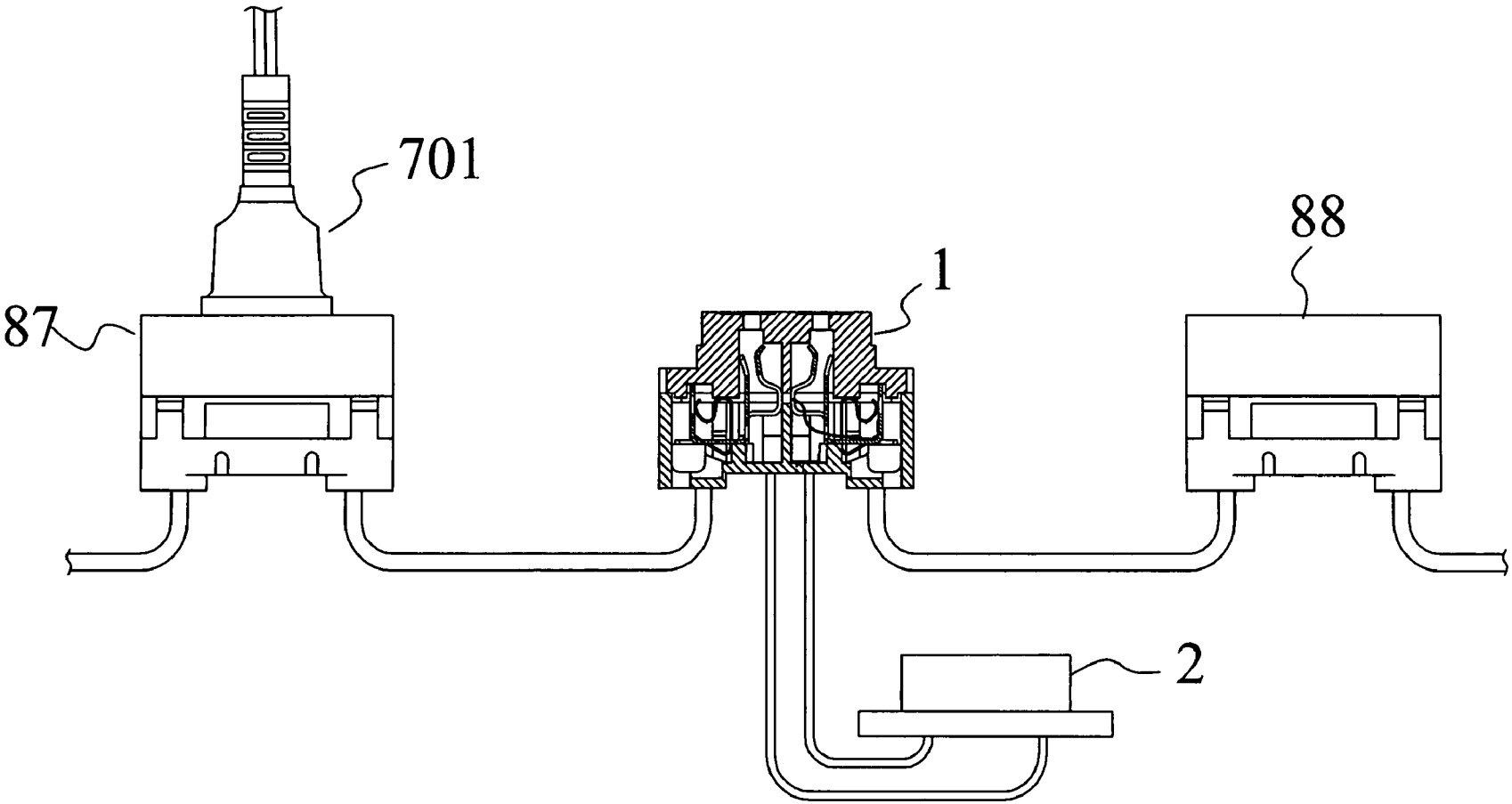
FIG. 9 shows a schematic view of another implementation state of the present invention.

Referring to FIG. 9, after a power socket having a reed to active an alarm of the present invention is connected with wirings of other sockets 87, 88, a plug 701 of an external electric appliance is not directly inserted into the power socket 1 of present invention. However, as the power socket 1 of present invention has been already connected with the wirings of other sockets 87, 88, when temperature of entire wirings rises, the alarm device 2 can be also activated to give off the sound or illuminate, through the power socket 1 of present invention and by using the action of dual-metal complex reed.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A power socket having a reed to activate an alarm comprising:

a lower casing, an interior of which is provided with chambers, and a bottom end of which is provided with a set of power insertion holes for providing an insertion of a power-cord terminal;

an upper casing which is covered on a top of the aforementioned lower casing;

a conduction terminal which is installed in an interior of one of the aforementioned chambers of lower casing;

a conduction piece, which is installed in an interior of another one of the aforementioned chambers of lower casing, and an end of which is connected to an alarm device; and a dual-metal complex reed, which is provided with an affixing section, a deformation section, and a triggering end, with the affixing section being attached to the aforementioned conduction terminal, and the triggering end being opposed to the aforementioned conduction piece;

such that when the reed is deformed from temperature, the triggering end moves to connect with the conduction piece, thereby activating the alarm device.

2. The power socket having a reed to activate an alarm according to claim 1, wherein the said lower casing is provided with a second through-hole, such that a lead wire of the alarm device is connected to the conduction piece and the conduction terminal through the second through-hole.

3. The power socket having a reed to activate an alarm according to claim 1, wherein the deformation section of said dual-metal complex reed is connected with the conduction terminal at a distance that after deformation, the reed is fully attached to the conduction terminal.

4. The power socket having a reed to activate an alarm according to claim 3, wherein the deformation section of said dual-metal complex reed is in an arc shape.

5. The power socket having a reed to activate an alarm according to claim 4, wherein the deformation section of said dual-metal complex reed is in a parabolic shape.

6. The power socket having a reed to activate an alarm according to claim 1, wherein the affixing section of said dual-metal complex reed is attached on an inner side or an outer side of the conduction terminal.

7. The power socket having a reed to activate an alarm according to claim 1, wherein a normal open connection or a normal close connection is formed between the triggering end of said dual-metal complex reed and the conduction piece, before deformation.

8. The power socket having a reed to activate an alarm according to claim 1, wherein the conduction terminal is made by a copper piece which is bended into a shape of terminal, with two vertical plates being separated with each other by a distance; a bottom plate is connected between the vertical plates, with two sides of the first vertical plate being provided with fixing pins which are extended downward and two sides of the second vertical plate being connected to an outer plate which is bended by multiple angles, whereas two sides of the outer plate are formed outward into a projected station, and a lower end of the second vertical plate is again provided with a through-hole, such that the affixing section of dual-metal complex reed is connected on an inner surface of the first vertical plate and is bended along the inner surface of the first vertical plate; the deformation section being in a curve shape, such that an area of attachment to an inner side of the conduction terminal is increased after deformation, and the triggering end is bended by a larger angle after passing through the through-hole.

9. The power socket having a reed to activate an alarm according to claim 8, wherein the affixing section of said dual-metal complex reed is connected at an outer surface of the bottom plate.

10. The power socket having a reed to activate an alarm according to claim 8, wherein the affixing section of said dual-metal complex reed is connected at an outer side of the second vertical plate.

11. The power socket having a reed to activate an alarm according to claim 2, wherein the alarm device is located at an outer side of the socket.

12. The power socket having a reed to activate an alarm according to claim 2, wherein the alarm device is located in an interior of the socket.

13. The power socket having a reed to activate an alarm according to claim 2, wherein the alarm device illuminates for alarming.

14. The power socket having a reed to activate an alarm according to claim 2, wherein the alarm device gives off sound for alarming.

* * * * *